US007021356B2

(12) United States Patent
Kelders et al.

(10) Patent No.: US 7,021,356 B2
(45) Date of Patent: Apr. 4, 2006

(54) APPARATUS FOR DISPENSING A ROLL OF MATERIAL AND METHOD OF USING THE SAME

(75) Inventors: Johannes H. J. M. Kelders, Drunen (NL); Brian A. Vulpitta, Avon Lake, OH (US); Timothy S. Ferguson, Lakewood, OH (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 422 days.

(21) Appl. No.: 09/992,861

(22) Filed: Nov. 14, 2001

(65) Prior Publication Data

US 2002/0056526 A1 May 16, 2002

Related U.S. Application Data

(60) Provisional application No. 60/248,266, filed on Nov. 14, 2000.

(51) Int. Cl.
*B65H 49/18* (2006.01)

(52) U.S. Cl. ..... 156/523; 156/486; 156/527; 156/577; 156/579; 225/39; 225/46; 225/56; 206/411

(58) Field of Classification Search ..... 225/39, 225/46, 56; 206/411; 156/527, 577, 579, 156/269, 71, 486, 250, 523
See application file for complete search history.

(56) References Cited

U.S. PATENT DOCUMENTS

| | | | | |
|---|---|---|---|---|
| 2,016,527 | A | 10/1935 | Voigt | |
| 2,324,204 | A | 7/1943 | Fischer | |
| 2,584,065 | A * | 1/1952 | Taylor | 156/523 |
| 2,683,547 | A | 7/1954 | Fischer | |
| 2,722,331 | A | 11/1955 | Vogt | |
| 3,843,439 | A | 10/1974 | Rohlwing | |

(Continued)

FOREIGN PATENT DOCUMENTS

| | | |
|---|---|---|
| EP | 0 779 875 | 3/1999 |

(Continued)

*Primary Examiner*—Linda Gray
(74) *Attorney, Agent, or Firm*—Stephen D. Harper; Glenn E. J. Murphy

(57) ABSTRACT

The present invention provides an apparatus for dispensing a roll of material such as a pressure sensitive adhesive tape. The apparatus includes an enclosable housing having a roll holding piece, a cover piece, and a hinge assembly for joining the roll holding piece and cover piece. The hinge assembly permits opening of the housing while the cover piece and roll holding piece remain connected by the hinge assembly. The apparatus also includes an applicator located proximate to the dispensing end for applying a material to a substrate; a discharge opening for the material, and a cutting member located proximate to the dispensing end for cutting the material. The apparatus of the present invention is particularly useful as a hand-held tape dispenser.

18 Claims, 5 Drawing Sheets

U.S. PATENT DOCUMENTS

| | | | | | |
|---|---|---|---|---|---|
| 3,850,779 | A | * | 11/1974 | Pearson | 156/523 |
| 3,895,059 | A | * | 7/1975 | Link | 156/527 |
| 4,104,110 | A | | 8/1978 | Macosko | |
| D259,643 | S | | 6/1981 | Pearson | |
| 4,400,231 | A | | 8/1983 | Martin | |
| 4,627,560 | A | | 12/1986 | Samuelson | |
| 4,711,384 | A | | 12/1987 | Harris | |
| 4,961,525 | A | | 10/1990 | Corbo et al. | |
| 5,363,997 | A | | 11/1994 | Harris | |
| 5,468,332 | A | | 11/1995 | Dretzka et al. | |
| D365,852 | S | | 1/1996 | Parsey et al. | |
| 5,518,576 | A | | 5/1996 | Mendelovich et al. | |
| 5,670,014 | A | | 9/1997 | Mendelovich et al. | |
| 5,707,482 | A | | 1/1998 | Fusselman | |
| 5,878,932 | A | | 3/1999 | Huang | |
| 5,921,450 | A | | 7/1999 | Robinson | |

FOREIGN PATENT DOCUMENTS

| | | |
|---|---|---|
| GB | 1447904 | 9/1976 |
| GB | 196 04 617 A1 | 8/1997 |
| WO | WO00/75060 | 12/2000 |

* cited by examiner

APPARATUS FOR DISPENSING A ROLL OF MATERIAL AND METHOD OF USING THE SAME

CROSS REFERENCE TO RELATED APPLICATIONS

This application claims the benefit under 35 U.S.C. §119 (e) to U.S. provisional application Ser. No. 60/248,266 filed on Nov. 14, 2000, the disclosure of which is hereby incorporated by reference in its entirety.

FIELD OF INVENTION

This invention relates to an apparatus for dispensing a roll of material and a method of using the same. The apparatus is particularly useful for dispensing rolls of pressure sensitive adhesive tape.

BACKGROUND OF THE INVENTION

Apparatuses for dispensing rolls of materials, such as tape, are available in various forms. For example, the apparatus may be fixed in one location (such as a desk tape dispenser) while a desired amount of material is unwound from the roll. The apparatus may also be hand held to permit direct application of the material on the roll to a substrate.

Although hand held dispensers can be an efficient method for applying a roll of material to a substrate, there have been problems associated with their use. For example, U.S. Pat. Nos. 4,961,525; 5,363,997; 5,468,332; 5,878,932; and 5,921,450 disclose open hand held dispensers. These dispensers generally have some type of support member to which the tape roll is mounted to permit rotation of the roll on the support member. The tape is then cut by a blade present on the dispenser. This type of dispenser however has the disadvantage of being more readily susceptible to contamination because the tape roll is, for the most part, open to the atmosphere. Additionally, it is a common problem for the free tape end to adhere back to the roll after use, making it difficult to find the free tape end prior to the next use.

EP 0779 875 B1 discloses an enclosed tape dispenser that may be hand held, that includes a housing for holding a roll of tape. The housing is formed of two side pieces that are held together by a removable pin located near the dispensing end of the dispenser. The one side piece contains a holder for holding the roll of tape and the other side piece serves primarily as a cover to cover the roll of tape. To load a roll of tape into the dispenser, the two side pieces of the housing must be completely separated and then reassembled once the tape is loaded. This however permits the possibility of pieces being lost or the dispenser being improperly reassembled during loading of a roll of tape. For simplicity, it would be desirable to provide a dispenser that does not need to be completely separated to load a roll of tape and is easily loaded with a roll of material.

The present invention provides an improved apparatus for dispensing a roll of material such as pressure sensitive tape. The apparatus of the present invention (also referred to as a "dispenser") preferably has few parts, and preferably remains connected as one piece during loading of a roll of material into the dispenser.

SUMMARY OF THE INVENTION

The present invention provides an apparatus for dispensing a roll of material that includes an enclosable housing having a dispensing end and a hinge end. The housing includes a roll holding piece for holding a roll of material that preferably has a bottom, two opposing sidewalls, and a discharge end; a cover piece that preferably has a top, two opposing sidewalls and a discharge end; a hinge assembly for joining the roll holding piece and cover piece at the hinge end, where the hinge assembly is capable of opening the housing while the cover piece and roll holding piece remain connected by the hinge assembly. The housing also includes an applicator located proximate to the dispensing end for applying material to a substrate; a discharge opening for the material located proximate to the dispensing end; and a cutting member located proximate to the dispensing end for cutting the material.

In another embodiment of the present invention a method of using the apparatus is provided that includes mounting a roll of material in the housing of the dispenser; and applying at least a portion of the material to a substrate by pressing the material onto a substrate using the applicator.

The apparatus is especially suited for applying wider rolls of pressure sensitive adhesive tape such as packaging tape, paper tape, carton or strapping tape, duct tape, masking tape, correction tape, double stick tape, highlighter tape, selfstick note pad tape in roll form, aluminum foil tape, or joint tape; or transfer adhesive films such as highlighter tape, correction tape, or double stick tape; or combinations thereof. The apparatus can preferably be used in one hand.

DETAILED DESCRIPTION OF THE INVENTION

The present invention provides an apparatus for dispensing a roll of material (also referred to herein as a "dispenser"). The dispenser may be used for any material that is provided in roll form and is subsequently unwound from the roll. Examples of material that may be dispensed include for example pressure sensitive adhesive tape such as packaging tape, paper tape, carton or strapping tape, duct tape, masking tape, correction tape, double stick tape, highlighter tape, self-stick note pad tape in roll form, aluminum foil tape, or joint tape; or transfer adhesive films such as highlighter tape, correction tape, or double stick tape; or combinations thereof. Preferably, the apparatus is used for dispensing pressure sensitive tapes.

Figure 1:
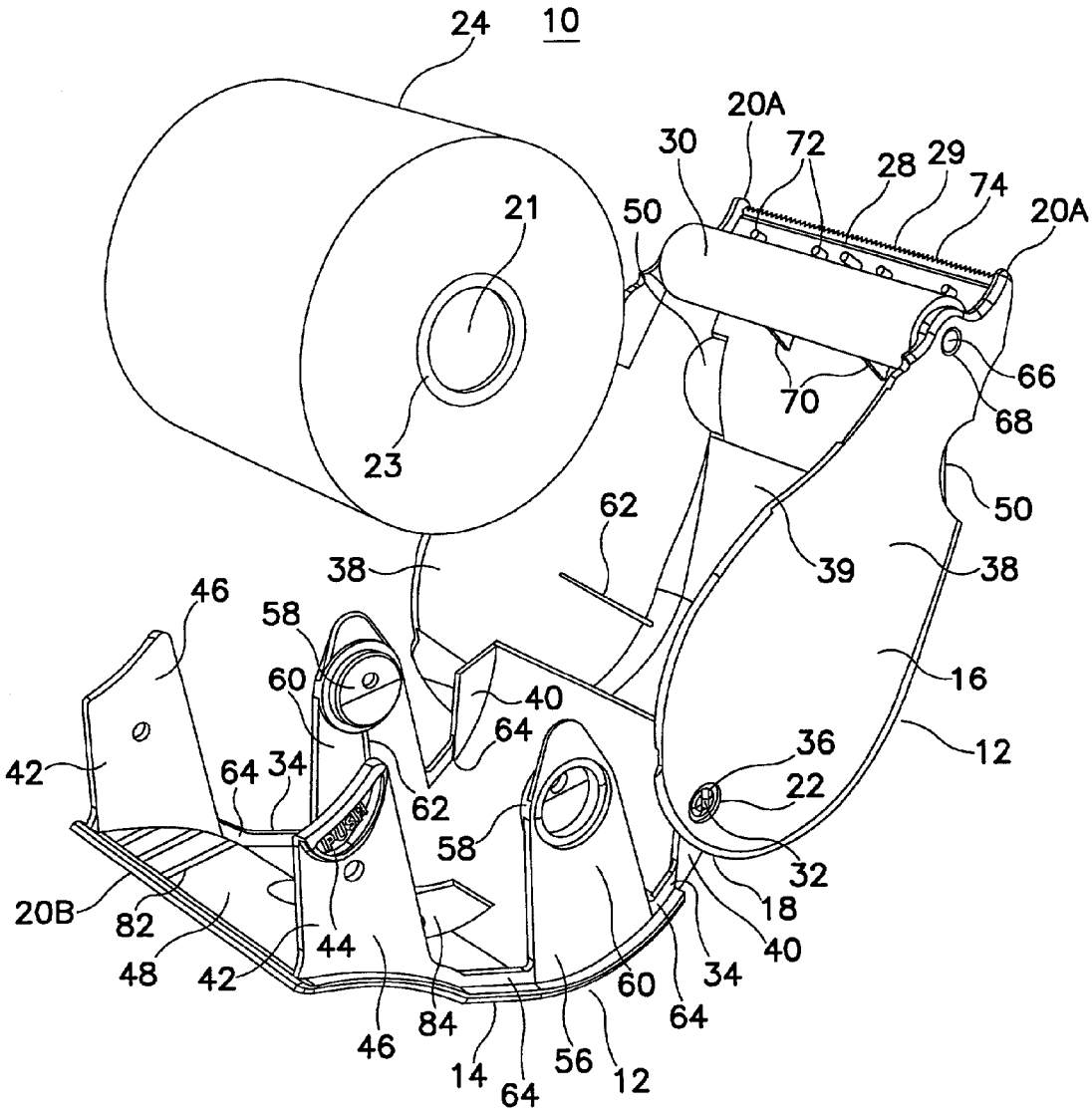
FIG. 1 is a perspective view of an embodiment of the present invention showing a dispenser in an open position, prior to loading a roll of material in the dispenser.
Figure 2:
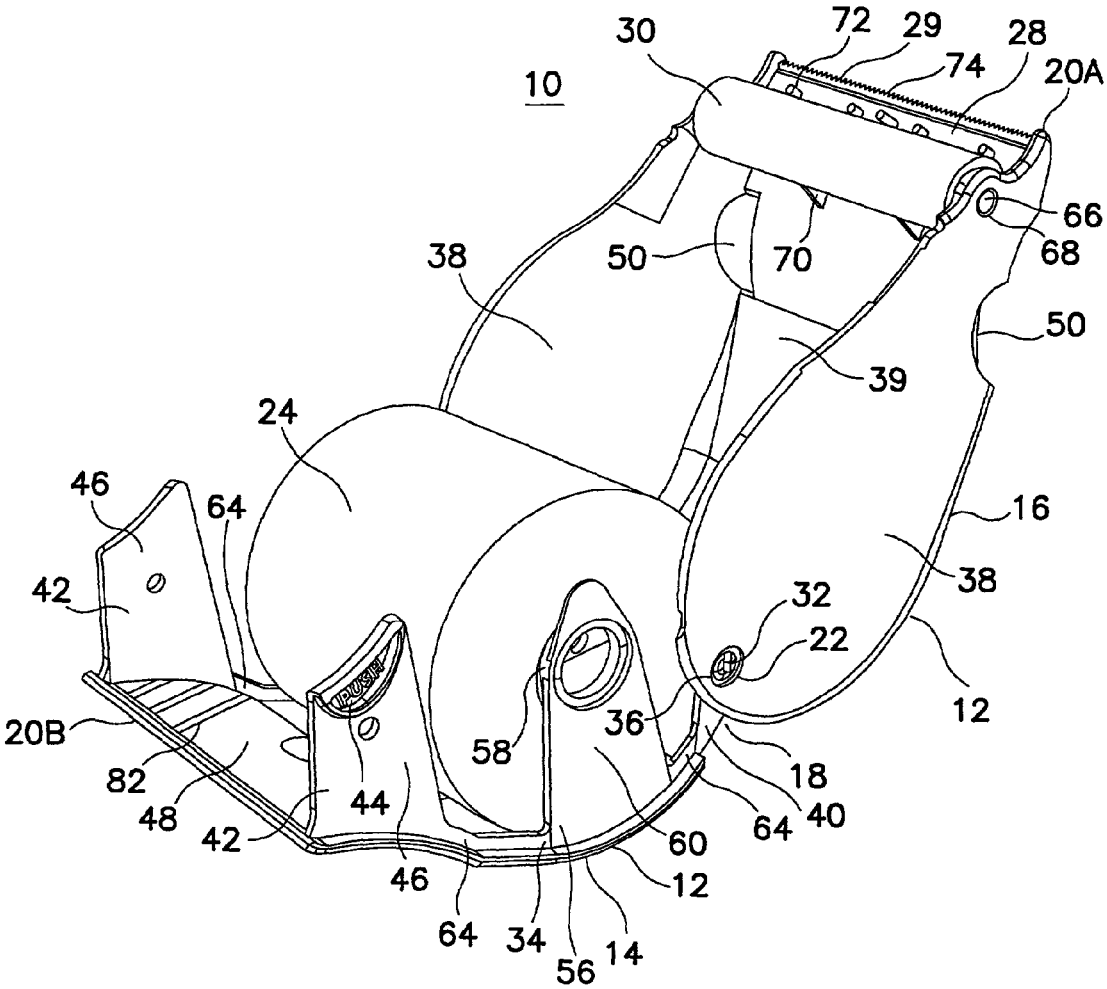
FIG. 2 is a perspective view of the dispenser in FIG. 1 showing the dispenser in an open position after loading a roll of material in the dispenser.
Figure 3:
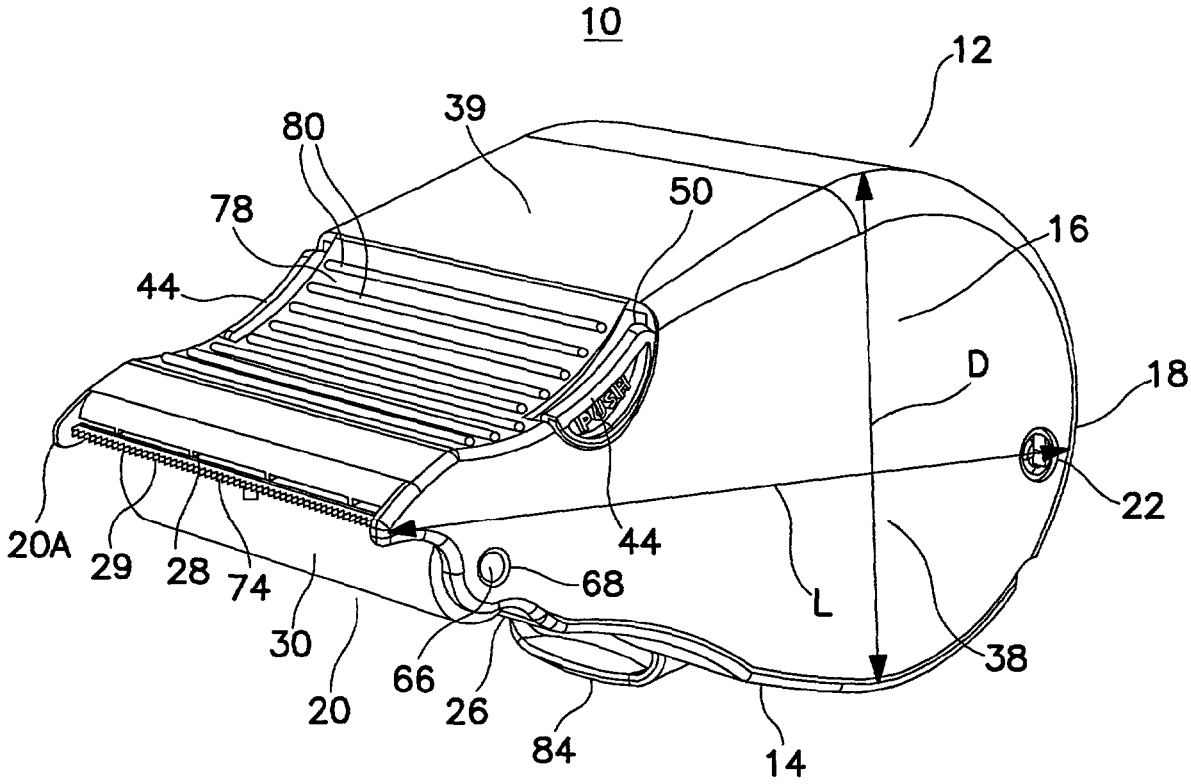
FIG. 3 is a perspective view of an embodiment of the present invention showing a dispenser in a closed position.

The dispenser of the present invention includes an enclosable housing that is hinged at one end to permit the opening and closing of the housing for loading a roll of material without disconnecting the pieces of the housing. Referring to the Figures, where like reference numerals refer to like elements, FIGS. 1, 2, and 3 are perspective views of an embodiment of a dispenser (10). FIG. 1 shows the dispenser (10) in an open position prior to loading a roll of material (24), such as tape, into the dispenser (10). FIG. 2 shows the dispenser (10) open with a roll of material (24) loaded in the dispenser (10), and FIG. 3 shows the dispenser (10) closed.

As shown in FIGS. 1, 2, and 3, the dispenser (10) includes a two piece housing (12) containing a roll holding piece (14) and a cover piece (16). The roll holding piece (14) and cover piece (16) preferably remain connected to each other by a hinge assembly (22) located at a hinge end (18) of the housing (12) during the loading of a roll of material (24). As shown in the Figures, the hinge end is the end where the cover piece (16) and roll holding piece (14) are joined by the hinge assembly (22). The dispenser also has a dispensing end (20), when the dispenser (10) is closed, formed between a discharge end (20A) of the cover piece (16) and a discharge end (20B) of the roll holding piece (14). The roll of material (24) is dispensed through a discharge opening (26) (shown in FIG. 3 only) located between an applicator (30) and the discharge end (20B) of the roll holding piece (14). The applicator (30) is used to apply pressure to the unwound material during dispensing to promote adhesion to a substrate (not shown). The applicator (30) as described in further detail hereinafter may be a stationary or rotatable device. After the material has been dispensed, it may be detached using a cutting member (28) located proximate to the cover discharge end (20A).

The roll holding piece (14) preferably forms the bottom of the housing (12) and includes a bottom (48) and two opposing side walls (34). The side walls (34) of the roll holding piece (14) include, opposing latching shoulders (46), opposing roll holding shoulders (60), and opposing hinge shoulders (40). The side walls (34) also include opposing lips (64) that provide further stability to the shoulders of the side walls (34). The bottom (48) of the roll holding piece (14) also includes one or more feet (84) that permits the housing (12) to rest level on a flat surface with the dispensing end (20) of the dispenser (10) resting above the surface (e.g., without contacting the surface). The shape of the bottom (48) of the roll holding piece is preferably designed to be capable of covering the roll of material (24) in combination with the cover piece (16), and for being ergonomically compatible to permit the housing (12) to be held in one hand. The features of the roll holding piece (14) will be described in more detail hereinafter.

The cover piece (16) preferably forms the top of the housing (12) and includes a top (39) and two opposing sidewalls (38). The cover piece (16) also preferably includes the applicator (30) and cutting member (28). The cover piece (16) is preferably shaped in a manner to cover the roll of material and to be ergonomically compatible so that the housing (12), when closed, can be held in one hand if desired. Preferably, the sidewalls (38) of the cover piece (16) are approximately in the shape of a tear drop as shown in the Figures. One skilled in the art will recognize that it is possible for the side walls (38) to be shaped differently; however preferred shapes are those that permit the housing (12) to be held in one hand for dispensing of the roll of material (24).

As mentioned before, the roll holding piece (14) and the cover piece (16) are joined at the hinge end (18) by a hinge assembly (22). The hinge assembly (22) may be any device or means known to those skilled in the art that permits the roll holding piece (14) and the cover piece to remain joined during opening and closing of the housing (12). A preferred hinge assembly (22) is shown in FIGS. 1, 2, and 3. The hinge assembly (22) in these Figures includes opposing hinge pins (32) located on the exterior surfaces of opposing hinge shoulders (40) of the roll holding piece (14). The hinge assembly (22) also includes opposing openings (36) located on opposing side walls (38) of the cover piece (16). As can be seen in the Figures, the hinge pins (32) of the roll holding piece (14) "snap" into the openings (36) of the cover piece (16) and permit rotation of the cover piece (16) about the hinge pins (32) of the roll holding piece (14). Although the hinge assembly (22) shown in the Figures permits the cover piece (16) and roll holding piece (14) to be disconnected if desired, it is preferred that they remain connected during loading and/or unloading of a roll of material from the dispenser (10).

Preferably, the hinge assembly (22) permits the cover piece (16) to be opened at least about 90 degrees, and more preferably between about 100 degrees and about 180 degrees as measured by an angle (not shown) formed by the intersection of two planes at the hinge end (18)—the first plane being formed between the discharge end (20A) of the cover piece (16) and the hinge end (18), and the second plane being formed between the discharge end (20B) of the roll holding piece (14) and the hinge end (18).

One skilled in the art will also recognize that there are many other ways to form a hinge assembly between the cover piece (16) and the roll holding piece (14), and that the present invention is in no way limited to the hinge assembly embodiment shown in the Figures. For example, the hinge pins (32) could also be located on the cover piece (16) with the openings (36) then being located on the roll holding piece (14) or combinations thereof. Alternatively, a hinge assembly similar to the type used on doors could be used.

In a preferred embodiment of the present invention, the housing (12) also includes a latching assembly (42) for securing the roll holding piece (14) to the cover piece (16). The latching assembly (42) preferably includes opposing tabs (44) located on the outer surfaces of the latching shoulders (46). The latching shoulders (46) preferably extend from the inner surface of the bottom (48) of the roll holding piece (14) proximate to the roll holding discharge end (20B). The latching assembly (42) also includes two opposing latch openings (50) located between the sidewalls (38) and the top (39) of the cover piece (16) through which the tabs (44) latch. One skilled in the art will recognize that there are various other ways to secure the cover piece (16) to the roll holding piece (14). For example, the latching shoulders (46) could be located on the cover piece (16) with the latch openings (50) being located on the roll holding piece (14). Alternatively, other latching mechanisms known to those skilled in the art could be used as the latching assembly.

As shown in FIGS. 1 and 2, the roll holding piece (14) also includes a roll holding assembly (56) for holding the roll of material (24). The roll holding assembly (56) includes two opposing lugs (58) located on the inner surface at the ends of the roll holding shoulders (60). Like the latching shoulders (46), the roll holding shoulders (60) extend from the inner surface of the bottom (48) of the roll holding piece (14). The spool (23), holding the roll of material, is mounted on the lugs (58) (shown in FIG. 2) in a manner to permit rotation of the spool (23) about the lugs (58). The diameter of the opening (21) in the spool (23), and the diameter of the lugs (58) should be selected such that the roll of material (24) may be rotated with minimal effort when the material is rolled out onto a substrate. Preferably, however, there should be sufficient friction between these two components to prevent the roll from turning freely during storage thereby causing the tape to unwind from the roll and adhere to the housing interior, or causing the free end of the tape protruding from the discharge opening to be retracted inside the housing.

In a preferred embodiment of the invention, the roll holding assembly (56) also includes opposing stabilizers (62) located on the inner surface of the sidewalls (38) of the cover piece (16) that serve to stabilize and support the roll holding shoulders (60) during use and storage. Stabilizers (62) are also preferably located on the inside surfaces of the roll holding shoulders (60) to provide additional stability for the roll of material (24) and to provide friction to prevent the roll from freely turning during storage.

One skilled in the art will recognize that there are various other ways to hold a roll of material within the housing (12). For example, the roll of material could be supported in some manner in the cover piece (16) of the housing (12). In this connection, opposing lugs could be affixed or formed, for example, on the inner surface of the cover (16) to which the roll of material (24) is mounted. Also, for example, the roll could contain pins that are secured to either piece of the housing.

The roll holding piece (14) also preferably includes a lip (64) as part of the side wall (34) that provides additional support and stability for the latching shoulders (46), the roll holding shoulders (60), and hinge shoulders (40). The lip (64) also is preferably in slight contact with the cover piece (16) when closed to prevent the cover piece (16) from contacting the roll during storage and use, and to provide additional stability to the dispenser (10). In a preferred embodiment, the lip preferably extends less than about 0.5 inches (1.27 cm), more preferably from about 0.05 inches (0.13 cm) to about 0.25 inches (0.64 cm), and most preferably from about 0.06 inches (0.15 cm) to about 0.125 inches (0.32 cm) above the interior surface of the bottom (48) of the roll holding piece (16).

As shown in FIGS. 1 and 2, one or more ridges (82) may be provided on the interior surface of the roll holding piece (14) proximate to the roll holding discharge end (20B). These ridges, although shown perpendicular to the cutting member (28), may also be in other directions, such as parallel to the cutting member or combinations thereof.

Although not shown, ridges may also be located on the exterior surface of the roll holding piece (14) located proximate to the roll holding discharge end (20B). Preferably, these ridges are parallel to the cutting member (28), although they may be in other directions, such as perpendicular as well. Additionally or alternatively, the exterior and/or interior surface of roll holding piece (14) proximate to the roll holding discharge end (20B) may be roughened. Such ridges (82) and/or surface roughening make it easier to remove any material which may become accidentally adhered to the interior or exterior of the housing (12).

The housing (12) also includes an applicator (30) for applying pressure to the material being dispensed so that the material more readily adheres to a substrate. The applicator (30) may be any device known to those skilled in the art that is capable of applying pressure to the material as it exits from the discharge opening (26). The applicator (30) may be designed to be located on the roll holding piece (14) or cover piece (16). For example, in one embodiment as shown in FIGS. 1, 2, and 3, the applicator (30) is in the form of a roller having two opposing pins (66) for securing the roller to the cover piece (16) via two opposing openings (68) in the cover piece (16). The applicator (30) may also be provided with additional supports. For example, in FIGS. 1 and 2, the applicator (30) is also supported by arc shaped supports (70) located in the interior of the cover piece (16). Although not shown, it is also possible for the applicator roller to be secured to the housing in other ways. For example the housing could contain opposing lugs, upon which a roller is mounted.

In alternative embodiments of the invention, the applicator (30) may be fixed or stationary, and/or may be an integral part of the housing. For example, the applicator may be a curved or arc-shaped outwardly projecting section of the housing (12). The applicator (30) may also take the form of a wiper blade secured to the housing in some manner. In this embodiment the wiper blade is preferably flexibly or resiliently attached to the housing (12) and preferably blunt or rounded to prevent premature cutting of the material.

In addition to the applicator (30), the housing (12) also contains a cutting member (28) having a cutting edge (29) for cutting the material after dispensing it from the roll (24). The cutting member may be any device known to those skilled in the art that is capable of severing the material to completely detach it from the roll. Preferably, as shown in FIGS. 1 and 2, the cutting member (28) is secured to the cover piece discharge end (20A). However, one skilled in the art will recognize that the dispenser could be designed so that the cutting member (28) is secured to the roll holding piece (14) of the housing (12). Any technique known to those skilled in the art may be used for securing the cutting member (28) to the housing (12). For example, in FIGS. 1 and 2, the cutting member (28) is secured to the cover piece by securing pins (72) located on the cover piece (16). The cutting member (28), especially when made from plastic, could also be an integral part of the housing (12) as opposed to a separate part that is secured to the housing (12). The cutting member (28) may be constructed of any suitable material such as metal or plastic. Preferably, however, the cutting member is constructed of metal.

In a preferred embodiment of the invention, the cutting edge (29) of the cutting member (28) is equipped with small teeth (74). Although the teeth (74) in FIGS. 1 and 2 are of equal length, they may also be of differing lengths, such as relatively long teeth alternated with relatively short teeth. The individual teeth may also advantageously project at different angles from the plane of the main body of the cutting member (28). Also, as shown in the Figures, the cutting edge (29) of the cutting member (28) is preferably angled slightly downward to facilitate cutting of the material.

As shown in FIGS. 1 and 3, the housing also preferably contains one or more feet (84) (one shown) to provide stability to the dispenser (12) when resting on a surface. Due to the curved shape of the housing (12), the foot (84) provides a level surface for which to rest the dispenser (10) when not held in the hand. In this manner, the dispenser will not rock or otherwise move when not held in the hand. For example, preferably the dispensing end (20) of the dispenser (10) remains above the surface that the dispenser rests on. Although the foot (84) is shown as being formed on or affixed to the bottom (48) of the roll holding piece (14) of the housing (12), it could also be located on the cover piece (16). One skilled in the art will recognize that there are many ways to design a foot or feet to provide stability to the dispenser when resting on a surface.

In a preferred embodiment, only one foot is present on the roll holding piece (14) that is located proximately vertically below the roll of material (24). The foot (84) in this embodiment also preferably extends in a tangential direction from the most rounded portion of the roll holding piece (i.e., directly below the roll) in the shape of a fan (e.g., the foot increases in width as a function of its distance from the most rounded portion of the roll holding piece (14)). The length and width of the foot is preferably chosen so that the dispenser will rest on a flat surface without movement and prevent the dispensing end (20) of the housing from contacting the surface that the dispenser rests on when not held in the hand. For example, the foot shown in the Figures has a length of about 0.75 inches to about 1 inch (1.90 cm to 2.54 cm) and a width of about 1 inch (2.54 cm) at its widest part, and a width of about 0.5 inches (1.27 cm) at its narrowest part.

In addition to the features shown in FIGS. 1 and 2, one skilled in the art will recognize that it may be desirable to add guides in the roll holding piece (14) and/or cover piece (16) for example to ensure proper threading of the material through the discharge opening (26). For example, a guide (not shown) may be provided which projects down from the top (39) of the housing (12) and which helps to ensure proper threading of the material through the discharge opening (26) when the material roll (24) is replaced.

The dispenser, once loaded with a roll of material (24) can be closed for use. FIG. 3 shows the dispenser of FIGS. 1 and 2 in a closed position. The housing (12), when closed, preferably has an ergonomically enhancing shape. By "ergonomically enhancing shape" it is meant that the housing is preferably shaped so that the dispenser can be grasped comfortably in one hand and the material can be dispensed with one hand. In this regard, preferably, the dispenser has an overall length (marked L, extending from the hinge end (18) to the discharge end 20(A) of the cover piece (16) on FIG. 3) of less than about 5 inches (12.7 cm), more preferably less than about 4 inches (10.16 cm), and most preferably from about 2 inches (5.08 cm) to about 3.75 inches (9.52 cm). The maximum height of the dispenser (referred to as the outer diameter and marked as D on FIG. 3) is preferably less than about 3 inches (7.62 cm), more preferably less than about 2.25 inches (5.72 cm) and most preferably from about 1.25 inches (3.17 cm) to about 2.25 inches (5.72 cm). These maximum preferred dimensions permit the dispenser to be easily held and used in one hand.

To further enhance the use in one hand, in a preferred embodiment of the present invention, there is an upper depression (78) with ridges (80) on the cover piece (16) into which the index finger can be inserted. Preferably, this upper depression is located a distance from the hinge end so that the index finger can rest comfortably on the depression (78).

In another preferred embodiment, the cover piece (16), following the upper depression (78), is gently cambered at the cover piece dispensing end (20A). This feature aids in not unnecessarily slowing down the discharge of material. Also, as can be seen from FIG. 3, the cutting member (28) is preferably recessed with respect to the discharge end (20A) of the cover piece (16). This serves to help protect the user from contacting the cutting edge during use. Recessing the cutting edge also helps to minimize damage (e.g., tearing) to the substrate to which the material is applied when the material is severed with the cutting member (28).

The housing (12) can be made of any material that is suitable for dispensing the desired roll of material. In a preferred embodiment of the present invention, the housing (except for the cutting blade) is made of plastic such as a thermoplastic material. Preferably, the housing pieces are formed by a molding process such as injection molding. In a preferred embodiment, the roll holding piece (14) is molded as one part, and the cover piece (16), except for the applicator and cutting member, is molded as a separate piece. In this manner, the dispenser contains preferably only four parts, making it easy to assemble. Moreover, the number of parts can be even further be reduced to two or three where the applicator (30) and/or the cutting member (28) are integral components of the housing (12) as previously described herein. One skilled in the art however will recognize that the cover piece (16) and/or roll holding piece (14) could be formed from multiple pieces if desired. It is also possible for the housing to be made of one piece as long as the roll holding piece and cover piece can be opened and closed.

The housing may be transparent, translucent, opaque, or combinations thereof. For example, the roll holding piece could be translucent, while the cover piece could be opaque. One or more dyes or pigments may also be incorporated into the housing to impart a desired color to the housing. For example, the cover piece could be one color while the roll holding piece could be another color.

The free end of the material (not shown) from the roll is directed to a discharge opening (26) formed between the applicator (30) and discharge end (20B) of the roll holding piece (14). The discharge opening (26) should preferably be sufficiently small so as to prevent the end of the tape from being easily pushed or pulled back into the housing (12). The distance between the discharge opening (26) and the cutting edge (29), which will determine the length of the tape end which protrudes from the housing (12) once the tape is cut, is preferably less than about 1 inch (2.54 cm) and more preferably from about 0.40 inches (1.0 cm) to about 0.87 inches (2.21 cm). Shorter distances can sometimes result in a material end which will have a propensity to be retracted into the housing (12). Longer distances will often yield a material end which will have a greater tendency to accumulate dirt or become stuck to the housing exterior or other objects.

With respect to the dimensions of the roll of (24) relative to the dispenser (10), the maximum total diameter of the roll of material (e.g., prior to any use) is slightly smaller than the internal dimensions of the housing (12) such that it fills the space provided almost completely. Preferably the smallest annular gap between the roll of material and the internal housing will be less than about 1 inch (2.54 cm), more preferably less than about 0.25 inches (0.64 cm), and most preferably as small as possible, while still permitting rotation of the roll within the housing.

In one preferred embodiment of the invention, the material roll (24) is configured to be compact in size, thus allowing the dispenser to be readily handled and manipulated by the user. In this regard, it is preferable to select a roll of material that has a relatively small spool (23). For example, preferably the inner diameter of the opening (21) in the spool (23) is less than about 3.0 inches (7.62 cm), more preferably from about 0.4 inches (1.0 cm) to about 2.0 inches (5.08 cm), and most preferably from about 0.31 inches (0.8 cm) to about 1.5 inches (3.8 cm). The radial thickness of the spool is preferably sufficient to provide strength to the spool, and is preferably less than about 0.37 inches (0.94 cm) and more preferably less than about 0.125 inches (0.32 cm). The use of a relatively small diameter spool permits a large quantity of tape to be supplied in a compact dispenser. Additional space can be save through the use of a spool having a single, relatively thin wall rather than a conventional double wall spool.

In a preferred embodiment, the total maximum diameter of the roll of material (when using a compact spool) is preferably less than about 4.5 inches (11.4 cm), more preferably less than about 3.5 inches (8.9 cm), and most preferably from about 1 inch (2.54 cm) to about 2.5 inches (6.4 cm). The amount of material that can be dispensed from the dispenser will of course depend upon the thickness of material. For example, for a 1.6 mil to 2.3 mil thick material, the dispenser will preferably dispense from about 20 meters to about 50 meters of material per roll. One skilled in the art will recognize however, that this amount of material will vary depending on the overall diameter of the roll of material and the thickness of material.

The dispenser of the present invention may be readily adapted to accommodate any width of roll of material that may be desired simply by changing the width of the housing (12), applicator (30), cutting member (28), and other appropriate components of the dispenser. If the dispenser is to be used with one hand, however, the width of the tape roll should preferably not be greater than about 4 inches (10.2 cm), and more preferably not greater than about 3 inches (7.6 cm), so that the dispenser may still be readily grasped and manipulated with one hand. In a more preferred embodiment of the present invention, the dispenser is capable of holding from about 0.20 inches (0.5 cm) to about 3 inches (7.6 cm) and most preferably about 0.4 inches (1 cm) to about 2 inches (about 4.8 cm to about 5.1 cm) wide rolls.

Figure 4:
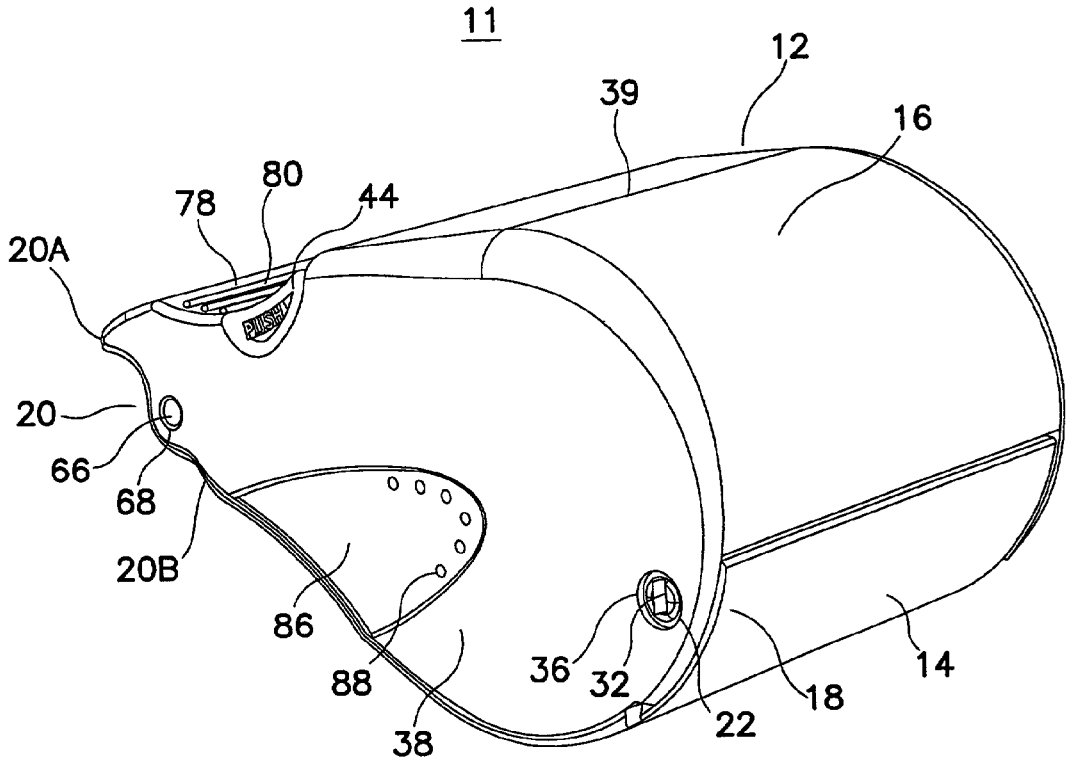
FIG. 4 is a perspective view of another embodiment of the present invention showing the dispenser closed and from the rear.
Figure 5:
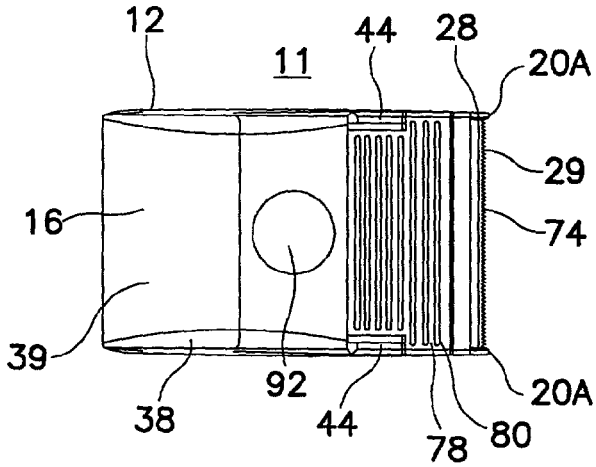
FIG. 5 is a top view of the dispenser in FIG. 4.
Figure 6:
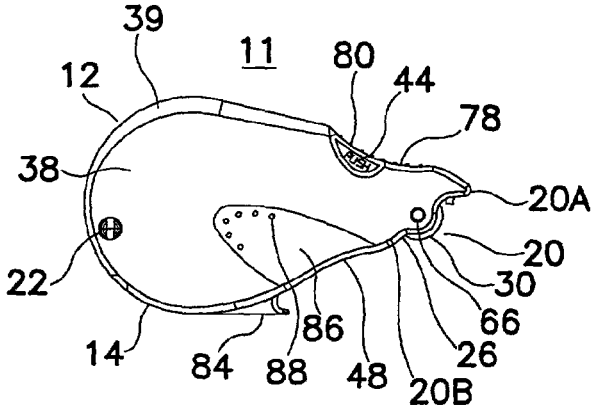
FIG. 6 is a side view of the dispenser in FIG. 4.
Figure 7:
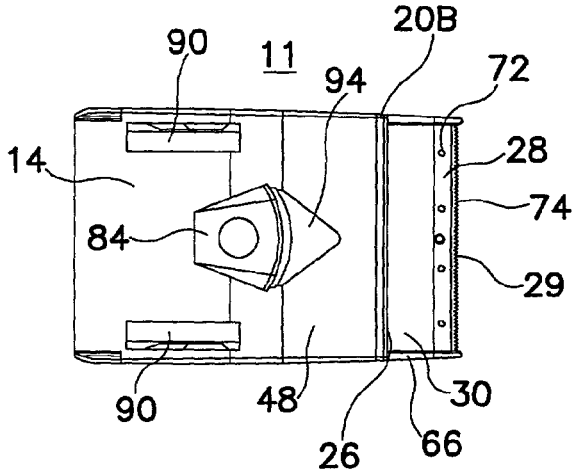
FIG. 7 is a bottom view of the dispenser in FIG. 4.

FIGS. 4, 5, 6 and 7 show another embodiment of the present invention which is similar to the dispenser (10) shown in FIGS. 1 to 3 except for a few additional features which will be described in further detail below. FIG. 4 is a rear perspective view of the dispenser (11) while FIG. 5 is a top view, FIG. 6 is a side view, and FIG. 7 is a bottom view of the same.

As can be seen in FIGS. 4 and 6, the sidewalls (38) of the cover piece (16) are provided with opposing shallow side depressions (86) with knobs (88). These shallow depressions are preferably located approximately between the roll holding shoulder (60) and applicator (30). These shallow depressions (86) provide a place for which a middle finger and thumb can be placed to aid in using the dispenser. One skilled in the art will recognize, that other shapes or devices located on the housing (12) could be used in addition to, or alternatively to, those shown in the Figures to make the dispenser more easily gripable. FIG. 5 shows an additional circular depression (92) located on the top (39) of the cover. This may be used for example for placement of a logo.

Another feature present in the dispenser (11) of FIGS. 4 to 7 is shown in FIG. 7. In FIG. 7, there are two windows (90) which may be openings or a transparent covering, preferably centered over the roll of material, through which one can observe the amount of material remaining on the roll. Although the windows (90) are shown as being located on the roll holding piece (14), they alternatively and/or additionally could be located on the cover piece (16). FIG. 7 also shows more clearly the foot (84) also discussed in connection with FIGS. 1 to 3. The foot (84) tangentially extends from the bottom (48) of the roll holding piece (14). There is also an opening (94) located on the bottom (48) proximate to the foot (84).

In another embodiment not shown, the dispenser may be fitted during storage with a cap which encloses at least the discharge opening (26) (preferably, also the applicator (30) and cutting member (28)) and protects the exposed end of tape which projects from the discharge opening (26).

The dispenser thus described can be used for dispensing any type of material that is present on a roll. Referring to FIGS. 1 to 3, to use the dispenser, the dispenser is opened by pushing the tabs (44) simultaneously to unlatch the cover piece (16) from the roll holding piece (14). A roll of material (24) can then be mounted to the lugs (58) of the roll holding assembly (56) as shown in FIG. 2 so that the side of the material intended for contact with the substrate (e.g., adhesive side) is pointing downwards towards the roll holding piece (14). The material is then pulled slightly from the roll (24) so that the material extends slightly from the discharge end (20B) of the roll holding piece (14) and to extend slightly past the applicator (30). The cover piece (16) can then be closed so that the tabs (44) of the latching assembly (42) on the roll holding piece (14) snap into the latch openings (50) on the cover piece (16).

Once the roll of material is loaded, the material can be dispensed by pressing the applicator (30) against a substrate so as to press the material against the substrate, and pulling the dispenser with pressure in a desired path to adhere the material to the substrate. As the user pulls the dispenser over the substrate, the material unwinds from the roll (24) and passes smoothly under the applicator (30). In this manner, the length of tape thus dispensed is caused to adhere to the substrate by the pressure exerted by the applicator against the substrate surface. After the desired length of material is dispensed, the hinge end (18) may be tipped upward so as to contact the cutting edge (29) with material in a manner to cut the material with the cutting edge (29).

Although the present invention has been described above with respect to particular preferred embodiments, it will be apparent to those skilled in the art that numerous modifications and variations can be made to those designs. The descriptions provided are for illustrative purposes and are not intended to limit the invention.

What is claimed is:

1. An apparatus for dispensing a roll of material comprising an enclosable housing having a dispensing end and a hinge end and comprising (a) a roll holding piece for holding a roll of material, the roll holding piece having a bottom, two opposing sidewalls, and a discharge end;

(b) a cover piece, the cover piece having a top, two opposing side walls, and a discharge end, wherein the top of the cover piece has at least one depression for placement of a finger;

(c) a hinge assembly for joining the roll holding piece and the cover piece at the hinge end, wherein the hinge assembly permits opening of the housing while the cover piece and roll holding piece remain connected by the hinge assembly;

(d) an applicator located proximate to the dispensing end for applying material to a substrate;

(e) a discharge opening for the material located proximate to the dispensing end; and (f) a cutting member located proximate to the dispensing end for cutting the material.

2. The apparatus of claim 1 further comprising a latching assembly having opposing latching shoulders extending from the bottom of the roll holding piece for securing the cover piece to the roll holding piece.

3. The apparatus of claim 1 wherein the applicator is located on the cover piece proximate to the discharge end of the cover piece and the applicator is rotatable or stationary on the cover piece.

4. The apparatus of claim 3 wherein the discharge opening is located between the applicator and the discharge end of the roll holding piece.

5. The apparatus of claim 1 wherein the cutting member is located on the cover piece proximate to the discharge end of the cover piece.

6. The apparatus of claim 1 wherein the interior surface of the bottom of the roll holding piece has one or more ridges, surface roughening, or a combination thereof, for preventing the material from adhering to the interior surface of the bottom.

7. The apparatus of claim 6 wherein the exterior surface of the bottom of the roll holding piece has one or more ridges, surface roughening, or a combination thereof for preventing the material from adhering to the exterior surface of the bottom.

8. The apparatus of claim 1 wherein the sidewalls of the cover piece have at least two side depressions for placement of a finger or thumb.

9. The apparatus of claim 1 wherein the bottom of the roll holding piece has one or more feet for resting the apparatus on a surface.

10. An apparatus for dispensing a roll of material comprising an enclosable housing having a dispensing end and a hinge end and comprising (a) a roll holding piece for holding a roll of material that has a bottom, two opposing sidewalls, and a discharge end;

(b) a cover piece that has a top, two opposing sidewalls and a discharge end, wherein the top of the cover piece has at least one depression for placement of a finger;

(c) a hinge assembly for joining the roll holding piece and cover piece at the hinge end, wherein the hinge assembly permits opening of the housing while the cover piece and roll holding piece remain connected by the hinge assembly;

(d) a latching assembly having opposing latching shoulders extending from the roll holding piece for securing the cover piece to the roll holding piece;

(e) an applicator located on the cover piece and proximate to the discharge end of the cover piece for applying material to a substrate;

(f) a discharge opening for the material located between the applicator and the discharge end of the roll holding piece; and (g) a cutting member located on the cover piece proximate to the discharge end of the cover piece for cutting the material.

11. The apparatus of claim 10 wherein the interior surface, the exterior surface, or both of the bottom of the roll holding piece has one or more ridges, surface roughening, or combinations thereof, for preventing the material from adhering to the surfaces of the bottom.

12. The apparatus of claim 11 wherein the cover piece has one or more depressions on the sidewalls for placement of a thumb or fingers.

13. The apparatus of claim 12 wherein the bottom of the roll holding piece has one or more feet for resting the apparatus on a surface.

14. A method of dispensing a roll of material comprising:

(a) providing an apparatus for dispensing a roll of material wherein the apparatus comprises an enclosable housing having a dispensing end and a hinge end and comprising (i) a roll holding piece for holding a roll of material and having a discharge end;

(ii) a cover piece that has a top, two opposing sidewalls, and a discharge end, wherein the top of the cover piece has at least one depression for placement of a finger;

(iii) a hinge assembly for joining the roll holding piece and cover piece at the hinge end, wherein the hinge assembly permits opening of the housing while the cover piece and roll holding piece remain connected by the hinge assembly;

(iv) an applicator located proximate to the dispensing end;

(v) a discharge opening for the material located proximate to the dispensing end; and (vi) a cutting member located proximate to the dispensing end;

(b) mounting a roll of material in the roll holding piece of the housing; and (c) applying the material to a substrate by pressing the material onto a substrate using the applicator.

15. The method of claim 14 wherein the mounting of the roll of material is carried out in a manner so that the material extends through the discharge opening and at least partially against the applicator when the housing is closed.

16. The method of claim 14 further comprising cutting the material with the cutting member to separate the roll of material from the material applied to the substrate.

17. The method of claim 14 wherein the material is pressure sensitive adhesive tape or a transfer adhesive film.

18. The method of claim 14 wherein the dispenser is held in a hand during the applying of the material to the substrate.

* * * * *

UNITED STATES PATENT AND TRADEMARK OFFICE

CERTIFICATE OF CORRECTION

PATENT NO. : 7,021,356 B2 
APPLICATION NO. : 09/992861
DATED : April 4, 2006
INVENTOR(S) : Kelders et al.

It is certified that error appears in the above-identified patent and that said Letters Patent is hereby corrected as shown below:

Title page,
Item [56], References Cited, FOREIGN PATENT DOCUMENTS, delete "GB 196 04 617 A1 8/1997" and insert -- DE 196 04 617 A1 8/1997 --.

Signed and Sealed this

Twentieth Day of June, 2006

JON W. DUDAS
*Director of the United States Patent and Trademark Office*